US005251452A

United States Patent [19]

Wieder

[11] Patent Number: 5,251,452

[45] Date of Patent: Oct. 12, 1993

[54] AMBIENT AIR VAPORIZER AND HEATER FOR CRYOGENIC FLUIDS

[75] Inventor: Lawrence Z. Wieder, Poway, Calif.

[73] Assignee: Cryoquip, Inc., Murrieta, Calif.

[21] Appl. No.: 851,739

[22] Filed: Mar. 16, 1992

[51] Int. Cl.[5] ..... F17C 9/02

[52] U.S. Cl. ..... 62/50.2; 165/179; 165/183

[58] Field of Search ..... 165/179, 183; 62/50.2

[56] References Cited

U.S. PATENT DOCUMENTS

| | | | |
|---|---|---|---|
| 3,177,936 | 4/1965 | Walter | 165/183 |
| 3,735,465 | 5/1973 | Tibbetts et al. | 165/183 |
| 4,343,156 | 8/1982 | Gauthier | 62/50.2 |
| 4,479,359 | 10/1984 | Pelloux-Gervais | 62/50.2 |
| 4,487,256 | 12/1984 | Lutjens et al. | 62/50.2 |

FOREIGN PATENT DOCUMENTS

| | | |
|---|---|---|
| 214170 | 10/1957 | Australia . |
| 352691 | 4/1961 | Switzerland . |
| 2079923 | 1/1982 | United Kingdom . |

*Primary Examiner*—Ronald C. Capossela
*Attorney, Agent, or Firm*—Harold L. Jackson

[57] ABSTRACT

A single pass ambient air heat exchanger for vaporizing and heating cryogenic liquids includes a plurality of vertically mounted and parallel connected heat exchange tubes. Each tube has plurality of external fins and a plurality of internal peripheral passageways symmetrically arranged about and in fluid communication with a central opening, preferably circular in cross section. A solid bar or rod extends within the central opening for a predetermined length of each tube to increase the rate of heat transfer between the cryogenic fluid in its vapor phase and the ambient air as compared to the rate of heat between the fluid in its vapor phase and the air in an unblocked tube so that the fluid is raised from its boiling temperature at the bottom of the tubes to a temperature at the top suitable for manufacturing and other operations.

34 Claims, 2 Drawing Sheets

AMBIENT AIR VAPORIZER AND HEATER FOR CRYOGENIC FLUIDS

BACKGROUND OF THE INVENTION

1. Field of the Invention

The present invention relates to ambient air vaporizers and heaters and more particularly to unidirectional flow vaporizers and heaters for cryogenic fluids.

2. Brief Description of the Prior Art

Atmospheric vaporizers have been known in the art for a long time. These devices are used in industry to vaporize relatively large quantities of a cryogenic liquid which is needed in the gaseous form for certain manufacturing and other operations. In essence, an atmospheric vaporizer is a heat exchanger which utilizes ambient heat to vaporize a very low boiling (cryogenic) liquid. A typical example for the use of atmospheric vaporizers/heat exchangers is the vaporization of liquid oxygen for use in industrial processes and welding operations.

State of the art atmospheric vaporizers/heat exchangers include a plurality of heat exchange elements which are finned tubes made of good heat conducting materials (usually aluminum). The finned tubes are mechanically assembled to one another and to a substantially rigid frame. Flow of the cryogenic fluid through the tubes is generally in a serial fashion i.e. from one tube to another to maintain the height of the vaporizer/heat exchanger within reasonable limits, for example, of the order of 6 to 25 feet. The relatively large surface of the fins facilitates efficient heat exchange with the environment; in other words, the fins promote relatively efficient absorption of heat from the ambient atmosphere and thus provide the heat required for vaporization and heating of the cryogenic liquid.

The prior art serial vaporizers connect a number of vertically oriented heat exchange tubes in series to vaporize the cryogenic liquid which enters the heat exchanger at a temperature well below the freezing point of water, e.g. about −300° F., and heat it to a temperature suitable for manufacturing or other operations e.g. within 10° to 40° F. of the ambient temperature.

A serial atmospheric vaporizer/heat exchanger, including specific dimensions for the external and internal fins of its elongated finned tubes, is described in U.S. Pat. No. 4,479,359.

To obtain the desired flow rate several groups of serially connected tubes may be placed in parallel. One prior art vaporizer manufactured by the assignee of this application utilizes 36 heat exchange tubes with each group of 6 connected in series. With such an arrangement, the flow of the cryogenic fluid is bi-directional i.e. up through one tube, down through the next etc. The temperature of the cryogenic fluid will increase from its entrance temperature e.g. about −300° F. to its exit temperature e.g. 20°-60° F., as it travels through the serially connected tubes.

Since the accumulation of ice on the external fins is a function of the interior temperature of the tube, the largest portion of the ice packs will form on the first several tubes. As a result large ice packs typically will accumulate at both the bottom and top of the first two, three or even four tubes in a six tube array with little, if any, ice accumulating on the tubes near the outlet unless the ambient temperature is near or below freezing. The iced unit will therefore have an uneven distribution of ice over the tubes and a relatively high center of gravity. The high center of gravity is particularly troublesome in meeting stringent design code requirements, e.g. 100 miles per hour wind loads and seismic zone 4 safety criteria, because of the bracing required.

In addition to the high center of gravity problem, the difference in temperature between the horizontal sections of adjacent heat exchange tubes in series with one another results in differential thermal gradients between the tubes and the need to mechanically compensate for such gradients in the lateral plane. Also, the most efficient heat transfer occurs in only one-half of the prior art series connected elements e.g. counter-flow between the downward flow of ambient air by natural convection and the upward flow of the cryogenic fluid The remaining elements are in co-current flow pattern with the downward flow of fluid and downward flow of air.

There is a need for a more efficient ambient air vaporizer with full counterflow which provides an improved ice build-up pattern with an attendant low center of gravity and an improved structural integrity with respect to thermal expansion and contraction.

SUMMARY OF THE INVENTION

In accordance with the present invention, an ambient air heat exchanger is provided for vaporizing cryogenic liquids and heating the resulting vapor to a temperature (such as 10°-40° F. below the ambient temperature) suitable for use in manufacturing or other operations. The heat exchanger includes a base adapted to be positioned on the ground in an outside area exposed to ambient air. A plurality of tubes having top and bottom ends are vertically mounted on the base. An inlet manifold is connected to the bottom of each tube for supplying the cryogenic fluid, at least partially in liquid state, to the bottom of each tube. An outlet manifold is connected to the top of each tube for receiving the heated vapor.

Each of the tubes has a plurality of external fins for transferring heat from the ambient air to the fluid within the tube. Each tube further defines a plurality of internal peripheral passageways symmetrically arranged about and in fluid communication with a central opening, preferably circular in cross-section. Closure means, such as a solid bar or rod, extends within the central opening for a predetermined length of the tube, (e.g. 65% or more of its length), to confine fluid flow to the peripheral passageways. Preferably, the central opening blockage commences at the top of the tubes and extends toward the bottom thereof. The blockage of the central opening increases the rate of heat transfer between the cryogenic fluid in its vapor phase and the ambient air as compared to the rate of heat transfer between the fluid in its vapor phase and the air in an unblocked tube so that the fluid is raised from its boiling temperature to a temperature at the top of the tubes suitable for manufacturing or other operations.

The features of the present invention may best be understood by the following description taken in conjunction with the accompanying drawing in which like parts are designated by like reference numerals.

DESCRIPTION OF THE PREFERRED EMBODIMENT

Figure 1:
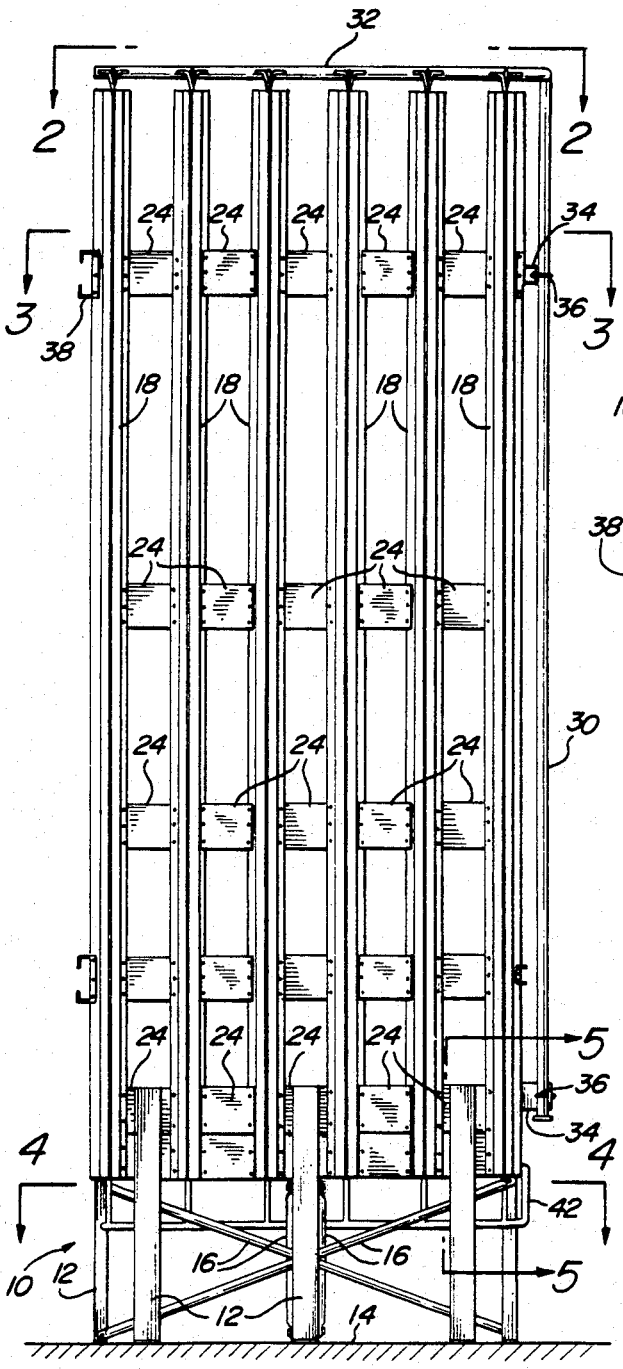
FIG. 1 is a side elevational view of a natural draft atmospheric vaporizer in accordance with the present invention.
Figure 3:
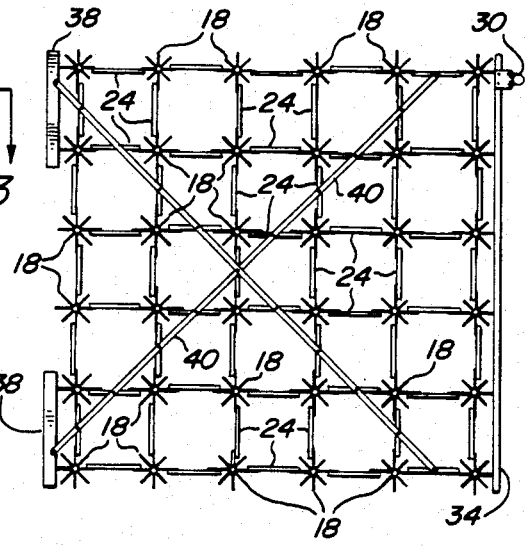
FIG. 3 is a cross-sectional view taken along lines 3—3 of FIG. 1.
Figure 2:
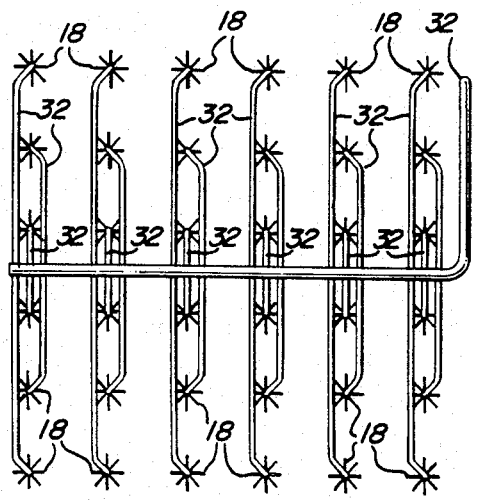
FIG. 2 is a top plan view taken along lines 2—2 of FIG. 1 showing only the top of the finned heat exchange tubes and the outlet manifold.
Figure 4:
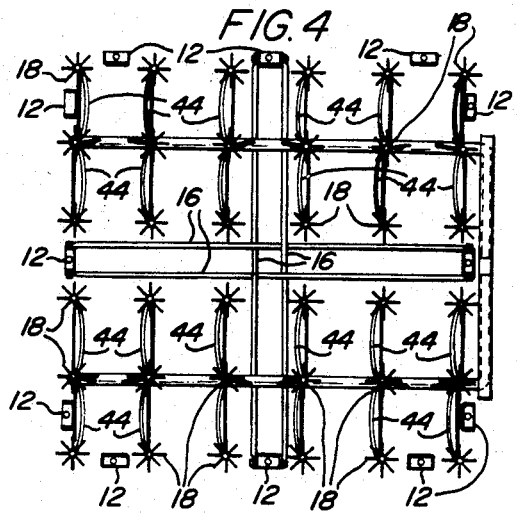
FIG. 4 is a cross-sectional view taken along lines 4—4 of FIG. 1.

Referring now to the drawings and particularly to FIGS. 1-4 an ambient air vaporizer and heater for cryogenic fluids in accordance with my invention includes a base 10 arranged to be positioned in an area exposed to the atmosphere. The base 10 comprises vertically oriented channel leg members 12 which may be suitably anchored to footings (not shown) embedded in the ground 14. Cross bars or rods 16 are connected (e.g. by bolts or other means) between the upper and lower portions of the channel leg members 12 as is best illustrated in FIGS. 1 and 4.

A plurality (36 in number) of vertically oriented finned heat exchange tubes or elements 18 are mounted to the base 10. The heat exchange tubes may be extruded from aluminum and include a hub 19 with a plurality of external fins 20 (e.g. 8 in number) extending radially therefrom and a central passageway 22 through which the cryogenic fluid is conducted. The external fins provide a large surface area through which heat may be transferred from the ambient air to cryogenic fluid flowing through the central passageway 22 as will be explained in more detail. It should be noted that the number of heat exchange tubes utilized in any given heat exchanger may vary depending upon the application.

Figure 5:
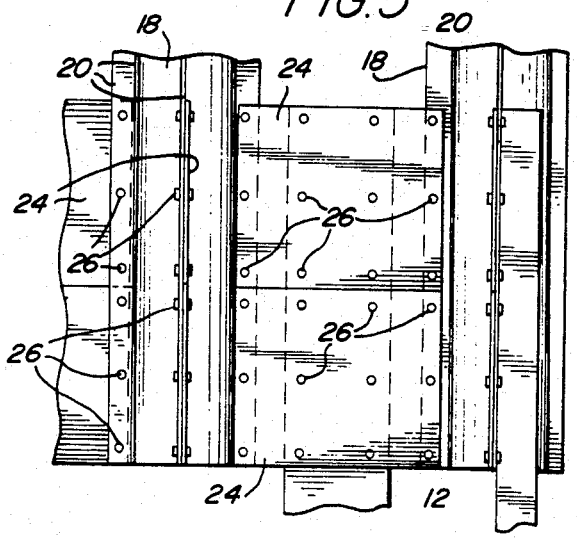
FIG. 5 is a cross-sectional view taken along lines 5—5 of FIG. 1 showing only one corner section of the lower portion of the vaporizer.

The heat exchange tubes 18 are secured together by mounting brackets or plates 24 which may also be made of aluminum. Suitable self-tapping screws 26 or other means may be used to fasten the mounting plates 24 to the fins 20 to provide a rigid and stable assembly. Suitable self-tapping screws 26 or other means may also be used to secure the lower mounting brackets 24 to the channel leg member 12. See FIG. 5. If desired the use of self-tapping screws for securing the brackets 24 to the external fins 20 may be eliminated by using the brackets and fin arrangement described in the co-pending application for an "Atmospheric Vaporizer Heat Exchanger" Ser. No. 825,943 filed Jan. 27, 1992 now U.S. Pat. No. 5,174,371 and assigned to the assignee of this application.

An outlet conduit 30 for conducting the vaporized and heated cryogenic fluid from the vaporizer is connected to the interior passageway 26 of each of the heat exchange tubes at the top end thereof via an outlet manifold 32. The outlet conduit is secured to the assembly of heat exchange tubes by horizontal brackets 34 and pipe clamp 36. The brackets 34 are mounted to the external fins of the heat exchange tubes on one side of the assembly by suitable means such as L-shaped brackets (not shown).

Referring to FIGS. 1 and 3, a pair of channel support members 38 are secured (via L-shaped brackets not shown) to the external fins of four of the heat exchange tubes a short distance from the top of the assembly. Cross bars 40 are connected between the support members 38 and brackets 24 (located diagonally across from the support members) by self tapping screws or other suitable means as illustrated in FIG. 3.

Cryogenic fluid is introduced to the interior of each of the heat exchange tubes at the bottom ends thereof by means of an inlet tube 42 and an inlet manifold 44 as is best illustrated in FIG. 4.

Figure 8:
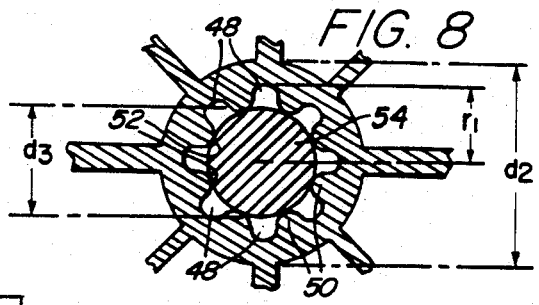
FIG. 8 is an enlarged cross-sectional view of the center section of the element of FIG. 6.
Figure 6:
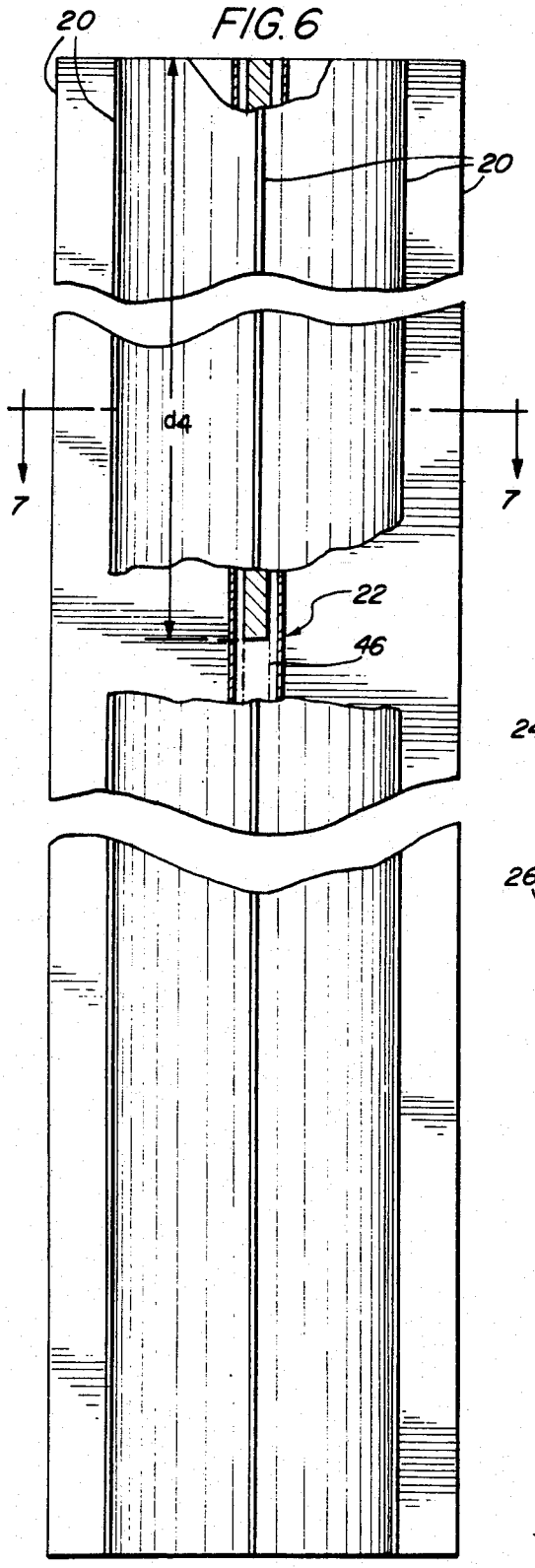
FIG. 6 is a side elevational view partially broken away of one of the heat exchange elements of the vaporizer assembly of FIG. 1.
Figure 7:
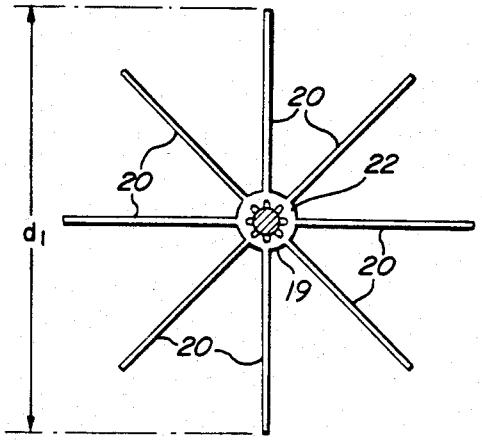
FIG. 7 is a cross-sectional view of the element taken along lines 7—7 of FIG. 6.

Referring now to FIGS. 6, 7 and 8, the central passageway in each heat exchange tube comprises a cylindrical central opening 46 (illustrated by the dashed lines in FIG. 6) and a plurality (i.e. 8) spaced, generally U-shaped, peripheral passageways 48 surrounding the central opening. The passageways 48 are separated by general triangular shaped internal projections 50 having rounded or radiused ends 52.

The ratio of the internal heat transfer surface (i.e. the inner surface formed by the projections 50) to the external heat transfer surface (i.e. the surface of the external fins and the exposed surface of the hub 19) is preferably within the range of 5:1 to 25:1 and most preferably about 15:1. A cylindrical rod 54 having a diameter $d_3$ substantially equal to the diameter of the central opening 46 is inserted into the central passageway to close the central opening for a portion of the length of the heat exchange tube and increase the rate of heat transfer between the cryogenic fluid and the ambient air as will be explained in more detail. A single heat exchange tube of the following dimensions will handle a cryogenic fluid flow between approximately 450 and 1200 standard cubic feet per hour for operating periods of eight continuous hours and longer with an inlet pressure between 100 to 400 psi: (1) a length of about 6 to 25 feet, (2) an outer fin diameter $d_1$ within the range of about 5 to 11 inches, (3) a hub diameter $d_2$ within the range of 1 to 2 inches, (4) a distance $r_1$ from the central axis of the tube to the radial extremity of the passageways 48 from about 0.40 to 0.85 inches, (5) a central opening diameter $d_3$ of about 0.5 to 1 inches, and (6) the rod 54 closing the central opening for about $\frac{2}{3}$ or more of the length of the tube. The total flow area of the passageways is preferably within the range of about 0.10 to 0.50 $in^2$.

For the case of $d_2$, $r_1$,an d $d_3$ equal to 1 inch, 0.425 inches and 0.5 inches, respectively, a total flow area through the central passageway with an unrestricted central opening is approximately 0.404 $in^2$. The flow area of the peripheral passageways 48 with the central opening closed by the rod 54 is about 0.208 $in^2$. However, the internal heat transfer surface area of the heat exchange tube per linear inch, i.e. about 4.1 $in^2/in$, remains substantially the same with or without the rod 54. The insertion of the rod 54 to block the central opening and route all of the cryogenic fluid through the peripheral passageways 48 increases the rate of heat transfer between the fluid and the outer surface of the peripheral passageways by a factor of about 2 as compared to the heat transfer rate in the unrestricted portion of the tube. This enables the heat exchanger to vaporize and heat the cryogenic fluid to a suitable temperature for industrial use with a single pass. The rod 54 may extend the entire length of the tube 36 but preferably extends from the top of the tube for about 50% to 80% length and most preferably about 65% of the tube's length.

In operation, the cryogenic liquid enters the bottom of the heat exchange tubes 18 through the inlet manifold 44 at about −300° F. (depending upon the particular liquid) and boils or vaporizes in the lower portion of each tube (e.g. lower ⅓ of each tube). As the fluid progresses toward the top of the heat exchanger, the fluid receives additional heat from the ambient air so that the fluid in the outlet manifold has a temperature within a range of about 10° to 40° of the ambient temperature.

I have found that a given number of parallel connected heat exchange tubes (e.g. 36) of the above dimensions with the central opening closed for ⅔ of the length of the tube has an increased thermal performance (e.g. as much as 10%) over that provided by a heat exchanger having 6 parallel sets of six series connected tubes of the same dimensions with the central opening left unrestricted and handling the same fluid flow rate.

The increase in thermal performance of the heat exchanger of the present invention over conventional series/parallel connected units having the same surface area may be accounted for in part by the true counter-flow between the downward flow of the ambient air in natural convection and the upward flow of the fluid in all of the vaporizer tubes.

As discussed previously, only one-half of the vaporizer tubes in conventional series/parallel connected units can take advantage of this counter-flow phenomenon.

In addition to the increase in thermal efficiency differential thermal gradients between tubes that would otherwise exist in a series/parallel arrangement are eliminated in the heat exchanger of the present invention because all of the tubes are at essentially the same temperature in any given horizontal plane. This lack of differential thermal gradients eliminates the need to compensate for thermal expansion and contraction gradients in the lateral plane, thereby reducing the need to compensate for the lateral gradients in meeting design code requirements.

Last, a majority of the ice does not accumulate at the upper portion of the heat exchanger thereby eliminating large ice packs at the top end along with the mechanical and aesthetic problems associated with such top end ice packs.

There has thus been described a novel unidirectional flow ambient air vaporizer and heater for cryogenic fluids. Various modifications of the described embodiment will become apparent to those skilled in the art without involving any departure from the spirit and scope of my invention as set forth in the appended claims.

What is claimed is:

1. An atmospheric heat exchanger for vaporizing cryogenic liquids and heating the resulting vapor to a temperature within an range of about 10°–40° F. of the ambient temperature comprising:

a base adapted to be positioned in an area exposed to the atmosphere;

at least one finned tube having a top and bottom end;

means for mounting the tube on the base so that the tube is vertically oriented;

an inlet manifold connected to the bottom end of the tube for supplying cryogenic fluid substantially in its liquid state thereto;

an outlet manifold connected to the top end of the tube for receiving the heated cryogenic vapor;

the tube having an upper portion, a lower portion, a plurality of external fins and a plurality of radially extending internal projections, the internal projections forming a plurality of passageways symmetrically arranged about a central opening, the passageways having an outer surface for contacting the fluid; and means for closing the central opening for the upper portion of the tube so that fluid flowing through said upper portion is confined to the passageways to thereby provide an increased rate of heat transfer between the fluid in its vapor phase and the outer surface of the passageways in said upper portion as compared to the heat transfer rate between the fluid in its vapor phase and the outer surface of the passageways in which said lower portion in the central opening is not closed, the lengths of the upper and lower portions being arranged so that the cryogenic fluid is substantially in its vapor phase in the upper portion.

2. The heat exchanger of claim 1 wherein said portion is about 65% of the length of the tube.

3. The heat exchanger of claim 1 wherein said upper portion of the tube in which the central opening is closed is within the range of about 50% to 80% of the length of the tube.

4. The heat exchanger of claim 3 wherein the total flow area of the passageways is about equal to the flow area of the central opening.

5. The heat exchanger of claim 4 wherein the total flow area of the passageways is within the range of about 0.10 to 0.50 inches squared.

6. The heat exchanger of claim 5 wherein the total flow area of the passageways is about 0.2 inches squared.

7. The heat exchanger of claim 4 wherein the internal projections extend toward the tube axis about 0.4 R where R is the distance from the tube axis to the radial extremity of the passageways.

8. The heat exchanger of claim 3 wherein the central opening is circular in cross-section and wherein the closure means comprises a cylindrical rod.

9. The heat exchanger of claim 8 wherein the passageways are generally U-shaped.

10. The heat exchanger of claim 9 wherein the internal projections form eight passageways.

11. The heat exchanger of claim 10 wherein the ratio of the external heat transfer area of the external fins to internal heat transfer area of the passageways is within the range of about 5 to 1 to 25 to 1.

12. The heat exchanger of claim 11 wherein said ratio is about 15 to 1.

13. The heat exchanger of claim 11 wherein the plurality of external fins comprises eight fins.

14. The heat exchanger of claim 13 wherein the height of the external fins is within the range of 2 to 7 inches.

15. The heat exchanger of claim 14 wherein said height of the external fins is about 3½ inches.

16. The heat exchanger of claim 11 wherein the height of the finned tube is within the range of 6 to 25 feet.

17. The heat exchanger of claim 16 wherein the height of the finned tube is about 20 feet.

18. The heat exchanger of claim 8 wherein the passageways are generally U-shaped.

19. The heat exchanger of claim 18 wherein the ratio of the external heat transfer area of the external fins to internal heat transfer area of the passageways is within the range of about 5 to 1 to 25 to 1.

20. The heat exchanger of claim 19 wherein said ratio is about 15 to 1.

21. The heat exchanger of claim 20 wherein the height of the external fins is within the range of 2 to 7 inches.

22. In a natural draft ambient air heat exchanger having a boiling zone for vaporizing cryogenic liquids and a vapor heating zone for heating the resulting vapor to temperature within a range of about 10°–40° F. of the ambient temperature, the combination comprising:

a base adapted to be positioned in an area exposed to the ambient air;

at least one finned tube having a top and bottom ends;

means for mounting the tubes on the base so that the tubes are arranged in a parallel vertical relationship, a lower portion of each tube encompassing the boiling zone for the cryogenic liquid and the upper portion of each tube encompassing the vapor heating zone for the vaporized fluid;

an inlet manifold connected to the bottom of each tube for supplying cryogenic fluid thereto, the cryogenic fluid being at least in part in its liquid state;

an outlet manifold connected to the top of each tube for receiving the superheated cryogenic vapor;

each of the tubes having a plurality of external fins for transferring heat from the ambient air to the fluid within the tube and defining a plurality of generally U-shaped internal peripheral passageways symmetrically arranged about and in fluid communication with a central circular-shaped opening, the peripheral passageways having an outer surface for contacting the fluid; and closure means extending within the central opening from the top thereof for a predetermined length of each tube, so that fluid flowing through said predetermined length is confined to the peripheral passageways to thereby provide an increased rate of heat transfer between the fluid in its vapor phase and the outer surface of the peripheral passageways in said predetermined length as compared to the rate of heat transfer between the fluid in its vapor phase and the outer surface of the passageways in which the fluid is not confined to the passageways, the predetermined length of the tube extending above the boiling zone.

23. The heat exchanger of claim 22 wherein said predetermined length of each tube is at least 50% of the length of the tube.

24. The heat exchanger of claim 23 wherein said predetermined length is about 65% of the length of the tube.

25. The heat exchanger of claim 23 wherein the total flow area of the passageways is about equal to the flow area of the central opening.

26. The heat exchanger of claim 25 wherein the total flow area of the passageways is within the range of about 0.10 to 0.50 inches squared.

27. The heat exchanger of claim 26 wherein the passageways are generally U-shaped.

28. The heat exchanger of claim 27 wherein the ratio of the external heat transfer area of the external fins to internal heat transfer area of the peripheral passageways is within the range of about 5 to 1 and 25 to 1.

29. An atmospheric heat exchanger for vaporizing cryogenic liquids and heating the resulting vapor to a temperature within a range of about 10°–40° F. of the ambient temperature comprising:

a base adapted to be positioned in an area exposed to the atmosphere;

at least one finned tubes having top and bottom ends;

means for mounting the tube on the base so that the tubes are vertically oriented;

an inlet manifold connected to the bottom end of each of the finned tubes for supplying cryogenic fluid substantially in its liquid state to the bottom end of each of the tubes;

an outlet manifold connected to the top end of each of the tubes for receiving the heated cryogenic vapor;

each of the tubes having a plurality of external fins and a plurality of radially extending internal projections, the internal projections forming a plurality of passageways symmetrically arranged about a central opening, the passageways having an outer surface for contacting the fluid; and means for closing the central opening for one portion of the length of each tube commencing at substantially the top thereof so that fluid flowing through said one portion is confined to the passageways to thereby provide an increased rate of heat transfer between the fluid in its vapor phase and the outer surface of the passageways in said one portion as compared to the heat transfer rate between the fluid in its vapor phase and the outer surface of the passageways in which the central opening is not closed, said one portion being within the range of about 50% to 80% of the length of the tube.

30. The heat exchanger of claim 29 wherein said portion is about 65% of the length of the tube.

31. The heat exchanger of claim 30 wherein the total flow area of the passageways is about equal to the flow area of the central opening.

32. The heat exchanger of claim 31 wherein the total flow area of the passageways is within the range of about 0.10 to 0.50 inches squared.

33. The heat exchanger of claim 32 wherein the total flow area of the passageways is about 0.2 inches squared.

34. The heat exchanger of claim 29 wherein the central opening is circular in cross-section and wherein the closure means comprises a cylindrical rod.

* * * * *

UNITED STATES PATENT AND TRADEMARK OFFICE

CERTIFICATE OF CORRECTION

PATENT NO. : 5,251,452

DATED : 10/12/93

INVENTOR(S) : Wieder

It is certified that error appears in the above-identified patent and that said Letters Patent is hereby corrected as shown below:

Column 2, line 14, after "fluid" insert --.--.

Column 6, line 21, after "said" insert --upper--.

Signed and Sealed this

Nineteenth Day of April, 1994

Bruce Lehman

*Attest:*

BRUCE LEHMAN

*Attesting Officer*

*Commissioner of Patents and Trademarks*